US009108092B1

(12) United States Patent
Warner

(10) Patent No.: US 9,108,092 B1
(45) Date of Patent: Aug. 18, 2015

(54) ADJUSTABLE GOLF PUTTER

(71) Applicant: Stephen D. Warner, Hinckley, IL (US)

(72) Inventor: Stephen D. Warner, Hinckley, IL (US)

( * ) Notice: Subject to any disclaimer, the term of this patent is extended or adjusted under 35 U.S.C. 154(b) by 31 days.

(21) Appl. No.: 13/965,510

(22) Filed: Aug. 13, 2013

Related U.S. Application Data

(60) Provisional application No. 61/683,581, filed on Aug. 15, 2012, provisional application No. 61/699,662, filed on Sep. 11, 2012.

(51) Int. Cl.

| | |
|---|---|
| ***A63B 53/06*** | (2015.01) |
| ***A63B 53/00*** | (2015.01) |
| ***A63B 53/02*** | (2015.01) |
| ***A63B 53/04*** | (2015.01) |

(52) U.S. Cl.
CPC ..... *A63B 53/065* (2013.01); *A63B 53/007* (2013.01); *A63B 53/02* (2013.01); *A63B 53/0487* (2013.01); *A63B 53/06* (2013.01); *A63B 2053/025* (2013.01); *A63B 2053/026* (2013.01)

(58) Field of Classification Search
CPC ..... A63F 2053/026; A63B 53/065; A63B 53/007; A63B 53/02; A63B 53/0487; A63B 2053/025; A63B 53/06
USPC ..... 473/305, 309, 314, 315, 340, 342
See application file for complete search history.

(56) References Cited

U.S. PATENT DOCUMENTS

| | | | | |
|---|---|---|---|---|
| 4,194,739 | A * | 3/1980 | Thompson | 473/241 |
| 5,577,726 | A * | 11/1996 | Fenton | 473/305 |
| 6,001,024 | A | 12/1999 | Van Alen, II et al. | |
| 6,203,444 | B1 * | 3/2001 | McRae | 473/244 |
| 2011/0256954 | A1 * | 10/2011 | Soracco | 473/328 |

FOREIGN PATENT DOCUMENTS

WO WO2014026206 A1 * 2/2014

* cited by examiner

*Primary Examiner* — Benjamin Layno
(74) *Attorney, Agent, or Firm* — Taft Stettinius & Hollister LLP

(57) ABSTRACT

An adjustable golf club putter head, having a body portion with adjustment ports for receiving adjustment screws and locking ports for receiving locking screws, adjustment screws to be screwed through the adjustment ports formed in the body portion, locking screws to be screwed through the locking ports formed in the body portion, and a moveable face having a striking surface. The face has holes for receiving the adjustment screws, and holes for receiving and securing face locking screws. The adjustment screws are screwed independently inwardly and outwardly in a direction extending between the body portion and the face adjust the length of the screw portions extending between the body portion and the face, thereby adjusting the distance between a number of points on the body portion and the face. After adjustment, the locking screws secure the relative positions of the body portion and the face.

14 Claims, 6 Drawing Sheets

ADJUSTABLE GOLF PUTTER

Priority is claimed to U.S. Provisional Patent Application Ser. No. 61/683,581, filed on Aug. 15, 2012, and U.S. Provisional Patent Application Ser. No. 61/699,662, filed on Sep. 11, 2012, the contents of which are hereby incorporated by reference herein in their entirety.

FIELD OF THE INVENTION

The present invention relates to an adjustable golf club, and more particularly, to an adjustable golf putter that is adjustable in a number of ways and directions in order to maximize its utility to the golfer and improve the golfer's game.

BACKGROUND OF THE INVENTION

Adjustable golf putters have been known in the past. There are limitations under United States Golf Association (USGA) rules regarding the adjustability of putters used in USGA competition. For example, some rules prohibit the adjustment of a putter during the round of play; a putter may be adjustable provided that the adjustment cannot be readily made and that all adjustable parts are firmly fixed and there is no reasonable likelihood of them working loose during a round. Other USGA rules limit physical features of the putter, such as the heel to toe alignment and the line of play alignment of the putter shaft. It is therefore desirable to have the cost-effectiveness of an adjustable putter so that a player need not purchase a number of different putters, while also having an adjustable putter that complies with all rules of the USGA and other golf organizations.

SUMMARY OF THE INVENTION

It is an object of the present invention to provide a putter having a number of different available adjustments that can be made legally under USGA rules. These objects are achieved by providing a golf putter wherein the face of the putter can be permanently secured to not allow adjustment during the round, so as to satisfy such rules. The present invention also provides a putter that can be adjusted to open and close the face, toe in or toe out, which will change the direction of trajectory of the golf ball hit by the putter. The loft can be adjusted to be negative, neutral or positive. Also, the hosel of the putter of the present invention can be adjusted to change lie angle. Also, the putter of the instant invention can be adjusted so as to change the moment of impact, by pushing out or retracting the face of the putter.

DESCRIPTION OF A PREFERRED EMBODIMENT OF THE INVENTION

Figure 4:
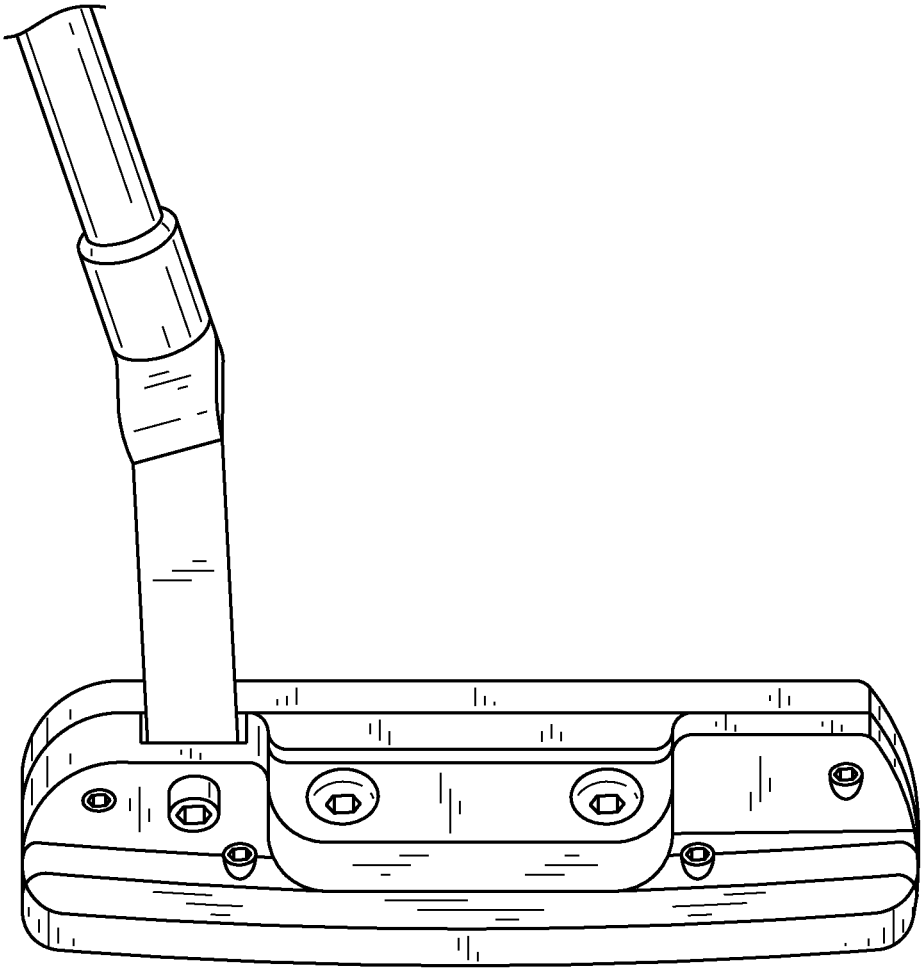
FIG. 4 is a perspective view of a putter of the present invention.
Figure 12:
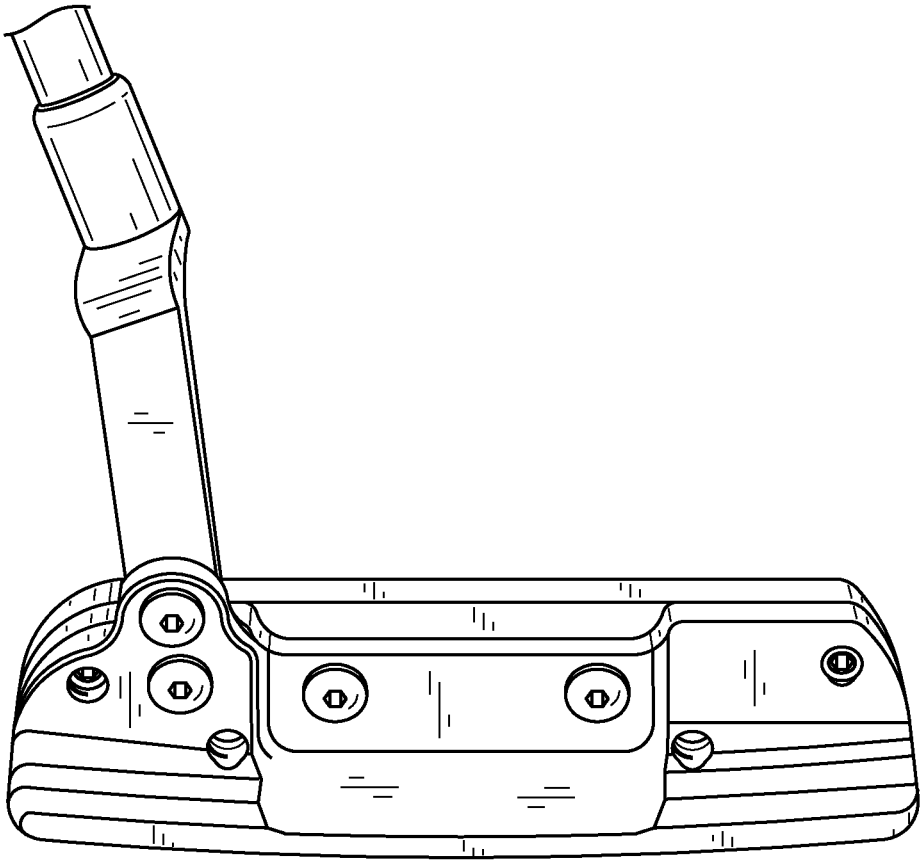
FIG. 12 is a perspective view of an embodiment of a putter of the present invention.

Embodiments of the putter head portion of the adjustable putter (entire putter is not shown in the drawings) are generally shown in overall views in FIGS. 4 and 12. The adjustable putter includes, as shown in the embodiment depicted in FIG. 1, a putter head portion 2, which comprises a hosel portion 4, a putter head main body 6, and a moveable face 8. A putter shaft (not depicted in the drawings), having a grip end and a connection end, is to be connected at the connection end of the shaft to the shaft connection portion 10 of the hosel 4, by conventional means.

Figure 2:
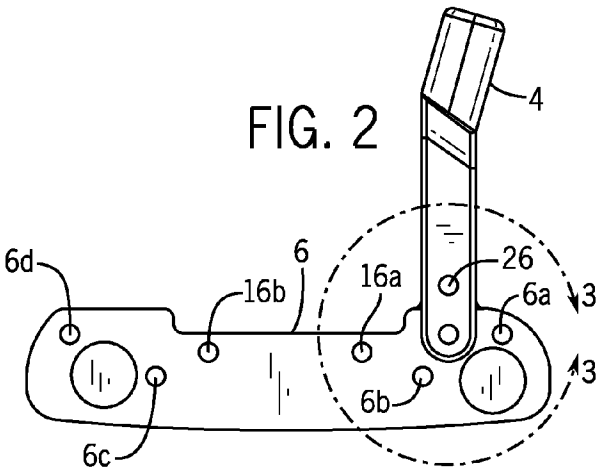
FIG. 2 is a front elevational view of an embodiment of the head portion of a putter of the present invention.

The main body 6 has a plurality, preferably four, adjustment ports that are drilled and tapped (threaded). These body adjustment ports 6*a*, 6*b*, 6*c*, and 6*d* are best seen in FIG. 2.

These body adjustment ports 6*a*, 6*b*, 6*c*, and 6*d* each have a corresponding threaded adjustment screw 12*a*, 12*b*, 12*c*, and 12*d* (shown in FIG. 1) that fits into each of the ports, preferably fixed by threading into the adjustment ports 6*a*, 6*b*, 6*c*, and 6*d*. These adjustment screws 12*a*, 12*b*, 12*c*, and 12*d* are preferably headless screws. These adjustment screws extend through the body adjustment ports 6*a*, 6*b*, 6*c*, and 6*d* and then extend toward the movable face 8. The movable face 8 comprises a plurality, preferably four, face adjustment ports 8*a*, 8*b*, 8*c*, and 8*d*, shown in FIG. 1. The adjustment screws 12*a*, 12*b*, 12*c*, and 12*d* extend through the body adjustment ports 6*a*, 6*b*, 6*c*, and 6*d* and then extend toward these face adjustment ports 8*a*, 8*b*, 8*c*, and 8*d*, into which the adjustment screws extend and are seated. In a preferred embodiment, the face adjustment ports 8*a*, 8*b*, 8*c*, and 8*d* are formed as indentations in the inner side of the face 8, so that the opposite, outer side of the face 8, i.e., the ball striking side of the face 8, has no holes or indentations. In a preferred embodiment, the face adjustment ports 8*a*, 8*b*, 8*c*, and 8*d* are unthreaded indentations in the face 8.

When the adjustment screws 12*a*, 12*b*, 12*c*, and 12*d* are adjusted by any suitable means, such as by rotation by using an Allen wrench, screw driver, or Torx wrench, the entire moveable face 8 of the putter head can thus be manipulated in all directions. The adjustment of the length of the portion of each of the adjustment screws 12*a*, 12*b*, 12*c*, and 12*d* extending between the body adjustment ports 6*a*, 6*b*, 6*c*, and 6*d* and the face adjustment ports 8*a*, 8*b*, 8*c*, and 8*d* yields a change in the distance between the main body 6 and the moveable face 8. As can be appreciated from the view of FIG. 1, this arrangement allows for almost infinite variation in the positioning of the face 8 relative to the main body 6, because each adjustment screw 12*a*, 12*b*, 12*c*, and 12*d* can be very finely adjusted to have a different distance extending between the body adjustment ports 6*a*, 6*b*, 6*c*, and 6*d* and the face adjustment ports 8*a*, 8*b*, 8*c*, and 8*d*. This yields a "floating face" characteristic for the putter of the present invention. The adjustment of each of the adjustment screws 12*a*, 12*b*, 12*c*, and 12*d* in the body adjustment ports 6*a*, 6*b*, 6*c*, and 6*d* and seating in the face adjustment ports 8*a*, 8*b*, 8*c*, and 8*d*, yields a change in the distance between the main body 6 and the moveable face 8 such that the club loft can be adjusted up or down.

Similarly, by such adjustment of the adjustment screws, the club face angle can be moved in or out, which will change the direction of trajectory of the ball. Also, when the adjustment screws 12*a*, 12*b*, 12*c*, and 12*d* are all screwed outwardly relative to the main body 8 so as to increase the length of the portion of the adjustment screws extending between the all points of the main body 6 and all points of the moveable face 8, the entire moveable face 8 is pushed outwardly. This allows the player to adjust the point of impact between the face 8 and the golf ball so as to suit the player's preference.

Figure 1:
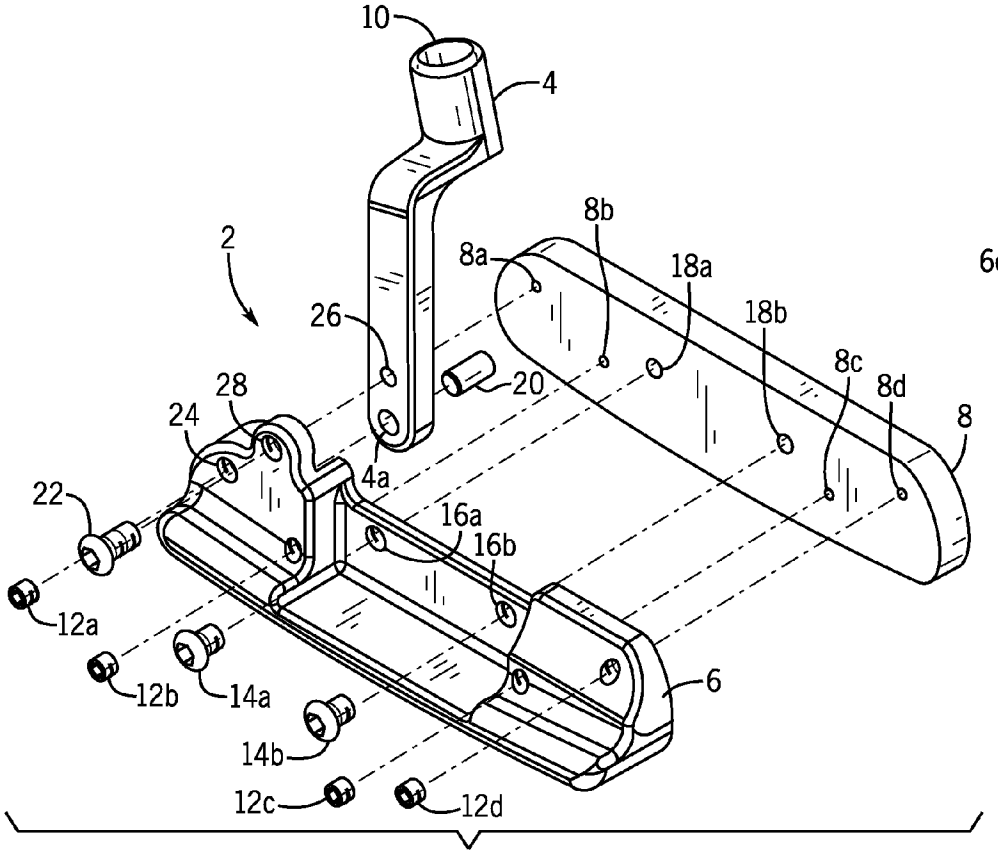
FIG. 1 is an exploded perspective view of an embodiment of the head portion of a putter of the present invention.

To comply with USGA and other golf organization rules prohibiting the adjustment of a putter during the round of play, a locking mechanism for the floating face is provided. In a preferred embodiment as shown in FIG. 1, the locking mechanism is realized in that the putter head portion 2 of the present invention also comprises a plurality, preferably two, face locking screws 14*a*, 14*b* and corresponding ports into which the screws can be secured. These face locking screws 14*a*, 14*b* fit into body locking ports 16*a*, 16*b*, which can optionally be unthreaded, and then extend into threaded face locking ports 18*a*, 18*b*, formed in the face 8. These ports are shown in FIG. 1. The face locking screws 14*a*, 14*b* are used to finally secure the relative positions of the body 8 and the face 6 after all of the desired adjustments have been made by adjustment of the adjustment screws 12*a*, 12*b*, 12*c*, and 12*d* in the body adjustment ports 6*a*, 6*b*, 6*c*, and 6*d* and the face adjustment ports 8*a*, 8*b*, 8*c*, and 8*d*. Therefore, the floating face, once adjusted, can be finally secured by using this locking mechanism in order to comply with competition rules.

Figure 3:
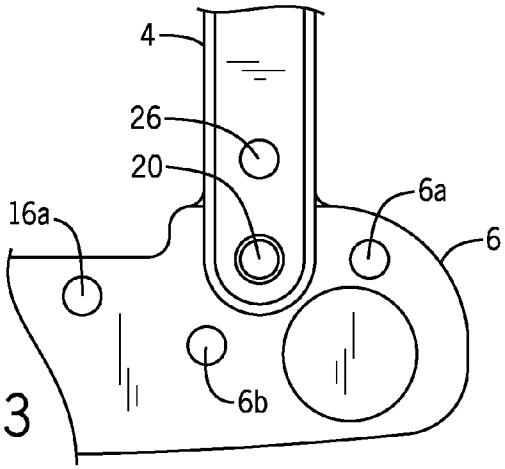
FIG. 3 is an enlarged front elevational view of the head portion of a putter of the present invention.

The putter according to the present invention also can, in a preferred embodiment, include an adjustable hosel 4, allowing adjustment of the lie angle of the putter, independently of the adjustment of the floating face. The hosel adjustment feature, shown in FIGS. 2-3, is realized in a hosel 4 including a hosel pin hole 4*a* into which a hosel pivot dowel pin 20 can be inserted. The hosel pivot dowel pin 20 also is inserted into a body pin hole 28 formed in the body 6, thereby forming a pivoting connection between the body 6 and the hosel 4. The hosel 4 pivots around the dowel pin 20 in a direction 3 relative to the main body 6, thereby allowing adjustment of the lie angle of the putter. An example lie angle adjustment is depicted in FIG. 3. After the desired lie angle is established by this pivoting adjustment, the hosel locking screw 22, shown in FIG. 1, is engaged in hosel locking ports. The hosel locking port can be formed in the main body 6, such as the port 24 depicted in FIG. 1. A hosel locking port 26 also is formed in the hosel portion 4 itself, as shown in FIGS. 1-2. The hosel locking screw 22 is then secured in one or more of the hosel locking ports, preferably by threaded engagement. This allows the position of the adjustable hosel 4 to be secured in a manner that complies with competition rules prohibiting adjustment during play.

A unique advantage of the putter according to the present invention resides in the fact that the components of the putter are completely separable and separately replaceable. The components can be changed independently of each other. The body 6, hosel 4, and the face 8 may be made of a large assortment of materials that complement each other, and can be independently replaced to suit the desires of the player. The adjustment screws can be independently replaced such that, by varying the lengths and materials of the screws, a large variety of positions of the face 8 respective to the body 6 can be achieved. The independent replaceability of the parts yields improved utility and economies of operation, as some parts can be replaced when different features or characteristics are desired, or when worn out.

Figure 6:
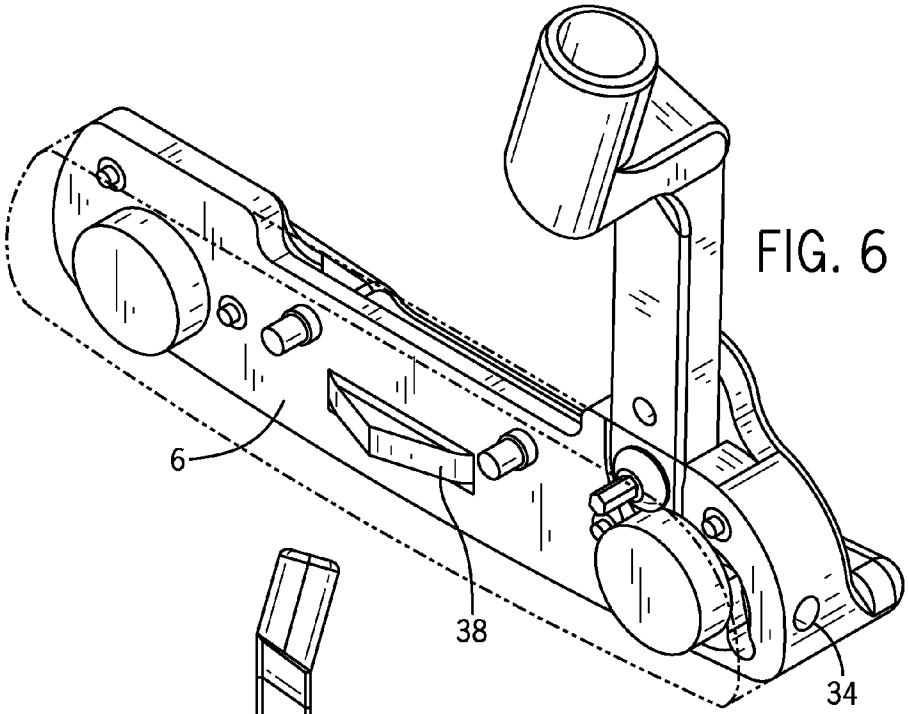
FIG. 6 is a front perspective view of an embodiment of the main body and hosel portion of the putter of the present invention.
Figure 8:
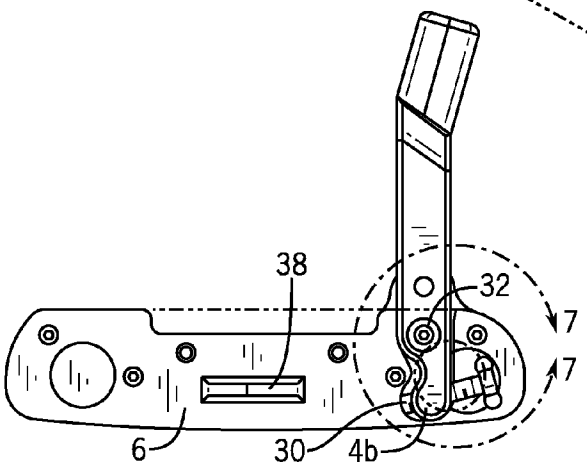
FIG. 8 is a front elevational view of an embodiment of the main body and hosel portion of a putter of the present invention.
Figure 5:
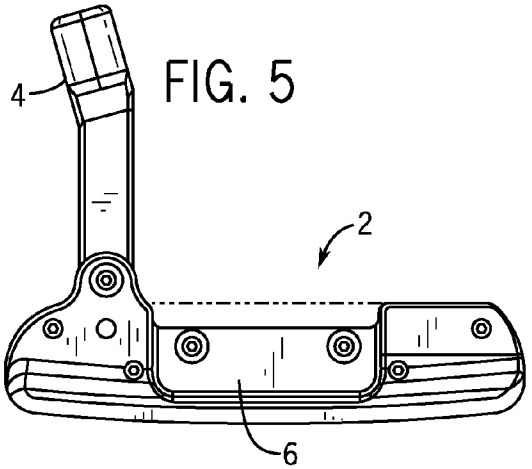
FIG. 5 is a rear elevational view of an embodiment of the head portion of a putter of the present invention.
Figure 7:
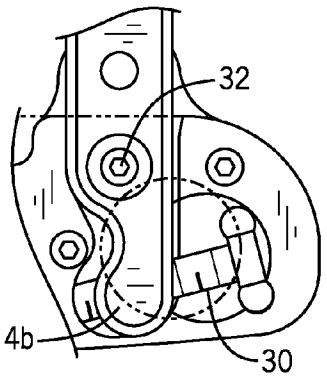
FIG. 7 is an enlarged front elevational view of the hosel adjustment mechanism of the embodiment shown in FIG. 6.
Figure 10:
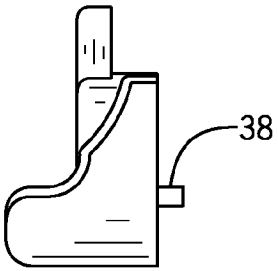
FIG. 10 is a left side elevational view of an embodiment of the main body of a putter of the present invention.
Figure 11:
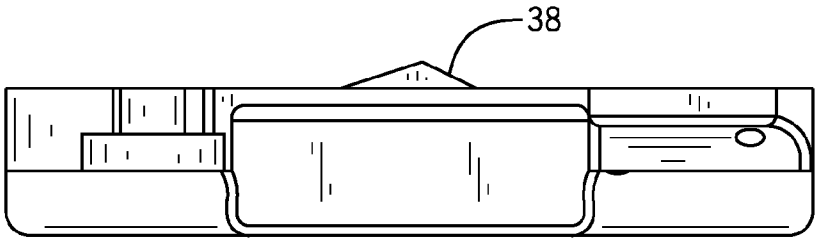
FIG. 11 is another side view of an embodiment of the main body of a putter of the present invention.
Figure 13:
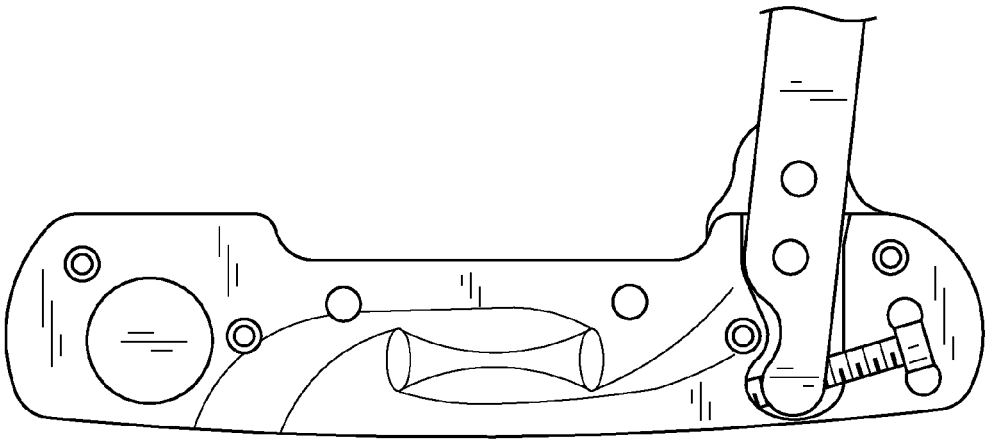
FIG. 13 is an elevational view of the main body and hosel portion of an embodiment of a putter of the present invention.

An alternative embodiment of the putter head portion 2 is seen in FIGS. 5-8. In this embodiment, the hosel is adjusted using a hosel adjustment mechanism. The hosel adjustment mechanism comprises, as shown in particular in FIGS. 8 and 13, a hosel tail 4*b* that is part of the hosel that extends downwardly toward the base of the main body 6. The hosel tail 4*b* engages with a lie angle adjusting screw 30, best seen in FIG. 7 and FIG. 13. The lie angle adjusting screw 30 is threaded on its outer portion and has a head or screwdriver-receiving slot at its end that allows for adjustment by turning of the screw lie angle adjusting screw 30 by the golfer. The golfer can turn the lie angle adjusting screw 30 by conventional means, including hand-turning, or means of inserting a tool such as a screwdriver into the access port 34 shown in FIG. 6 to engage with a screwdriver-receiving slot formed in the head of the screw 30. The turning of the lie angle adjustment screw 30 moves the hosel tail 4*b* in rightward or leftward directions (as shown in FIG. 7) relative to main body 6 of the putter head 2, by reason of the threads on the outer portion of the lie angle adjustment screw 30 engaging with internal threads in a bore hole formed in the hosel tail 4*b* and thereby forcing the rightward or leftward movement. This rightward or leftward movement of the hosel tail 4*b* causes the axis of the hosel portion 4 to pivot around a pivot point 32 wherein a button head screw or bolt engages the hosel portion 4 with the main body 6 on a pivoting basis, moving roughly in direction 7 depicted in FIG. 8. The adjustment mechanism includes conventional means for pivoting and then locking the pivoted position of the hosel tail 4*b* relative to the main body 6, such as a screw lock mechanism. This has the effect of changing the lie angle of the putter and then locking the lie angle into its new adjusted position.

FIG. 6 also shows in shadow lines the added movable face 8 applied over the front face of the main body 6 in conjunction with the hosel adjustment mechanism as depicted in FIGS. 5-8.

Figure 9:
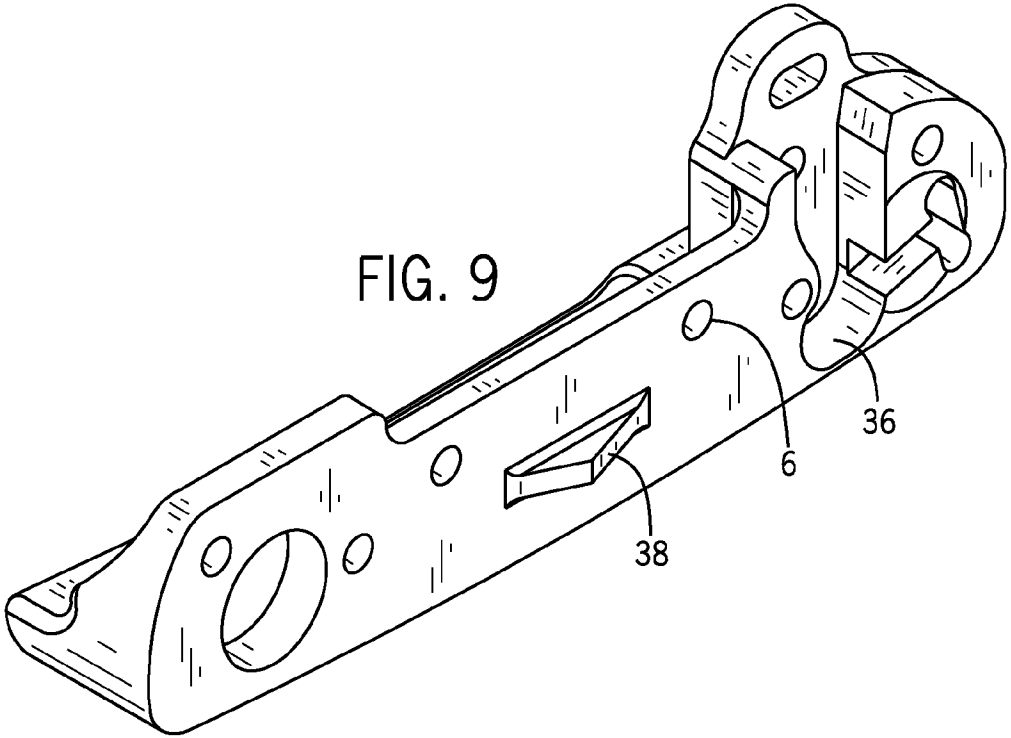
FIG. 9 is a front perspective view of an embodiment of the main body of a putter of the present invention.

FIG. 9 shows the main body 6 for the embodiment having the hosel adjustment mechanism of FIGS. 5-8, including an aperture 36 formed in the main body 6 for receiving the hosel adjustment mechanism, the aperture 36 being shaped to receive the lie angle adjustment screw 30 and the hosel tail 4*b*.

Figure 14:
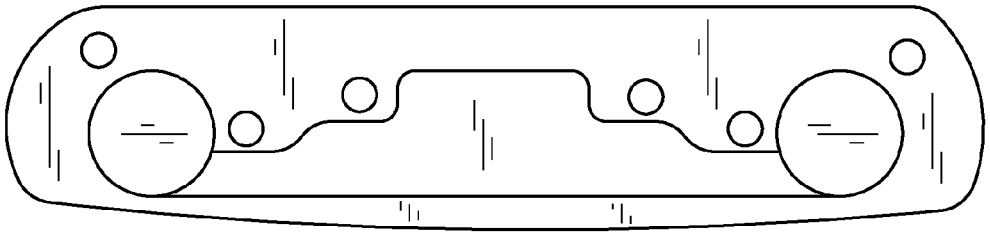
FIG. 14 is an elevational view of an embodiment of the movable face of a putter of the present invention.

In another embodiment of the invention, the main body 6 includes a protrusion or projection formed as an internal deflection ridge 38. This ridge is depicted in a number of the figures, including in particular FIGS. 9-11 and 13, where it is shown formed as an integral part of the main body 6, positioned on the front face of the main body 6. Its purpose is to comply with USGA rules by rendering the main body 6 unplayable as a golf club in the absence of the movable face 8. Because the ridge 38 would prevent straight and accurate use of the front face of the main body 6 as the golf ball hitting surface, the ridge 38 prevents use of the main body 6 as the hitting surface, in order to comport with USGA rules which would disallow use of the main body 6 without the movable face 8. In other embodiments of the invention, the movable face 8 has an alternative configuration as shown in FIG. 14.

It will be apparent to those skilled in the art that the invention disclosed herein may be embodied in other specific forms without departing from the spirit and scope herein. In particular, the invention could be adapted for use on golf clubs other than putters, such as irons or woods. Other known features of golf clubs in general and putters in particular could be adapted for use with the invention presented herein, such as those known features described in references such as Van Allen, II, et al., U.S. Pat. No. 6,001,024, issued Dec. 14, 1999, which is incorporated by reference herein in its entirety.

The invention claimed is:

1. An adjustable golf club head, comprising:

a body portion comprising adjustment ports for receiving adjustment screws and locking ports for receiving locking screws;

adjustment screws adapted to be screwed through the adjustment ports formed in the body portion;

locking screws adapted to be screwed through the locking ports formed in the body portion; and a moveable face that is separable from the body portion, comprising a ball striking surface formed on an outer surface of said face, an inner surface comprising holes or indentations for receiving ends of the adjustment screws, and holes or indentations for receiving and securing ends of face locking screws, wherein the adjustment screws are formed and adapted to be screwed independently inwardly and outwardly in a direction extending between the body portion and the face so as to increase or decrease the length of the screw portions extending between the body portion and the face, thereby adjusting the distance between a plurality of respective points on the body portion and the face, and wherein the locking screws are formed and adapted to secure the relative positions of the body portion and the face by engaging in the holes or indentations for receiving the locking screws.

2. A golf club comprising the adjustable golf club head according to claim 1, and a shaft connected to the golf club head.

3. The golf club according to claim 2, wherein the golf club is a putter.

4. The golf club according to claim 3, wherein the adjustable golf club head further comprises a projection formed on a front face of the body portion as a deflection ridge that prevents use of the front face of the body portion as a golf ball hitting surface.

5. The golf club according to claim 2, wherein the adjustable golf club head further comprises a projection formed on a front face of the body portion as a deflection ridge that prevents use of the front face of the body portion as a golf ball hitting surface.

6. The adjustable golf club head according to claim 1, further comprising:

a hosel adjustment mechanism for adjustment of a lie angle of the club head, wherein the hosel adjustment mechanism comprises a hosel comprising a hosel pin hole, and a hosel tail portion that extends downwardly toward a base of the body portion of the club head;

a hosel pivot dowel pin, wherein the hosel pivot dowel pin is inserted into the hosel pin hole and also is inserted into a body pin hole formed in the body portion of the club head, thereby forming a pivoting connection between the body portion of the club head and the hosel;

a lie angle adjusting screw positioned in the body portion of the club head, having threading formed on its outer portion and a head, providing for movement of threading of the lie angle adjusting screw through rotation of the lie angle adjusting screw, wherein the hosel tail engages with the lie angle adjusting screw, and the lie angle adjustment screw is shaped to engage and move the hosel tail portion in rightward or leftward directions relative to the body portion of the club head 2, by reason of the threading on the lie angle adjustment screw engaging with threading formed in a bore hole formed in the hosel tail upon rotation of the lie angle adjustment screw; and a screw lock mechanism that locks the lie angle into an adjusted position.

7. The adjustable golf club head according to claim 6, further comprising a projection formed on a front face of the body portion as a deflection ridge that prevents use of the front face of the body portion as a golf ball hitting surface.

8. A golf club comprising the adjustable golf club head according to claim 1, and a shaft connected to the golf club head.

9. The golf club according to claim 8, wherein the golf club is a putter.

10. The golf club according to claim 9, wherein the adjustable golf club head further comprises a projection formed on a front face of the body portion as a deflection ridge that prevents use of the front face of the body portion as a golf ball hitting surface.

11. The golf club according to claim 8, wherein the adjustable golf club head further comprises a projection formed on a front face of the body portion as a deflection ridge that prevents use of the front face of the body portion as a golf ball hitting surface.

12. The adjustable golf club head according to claim 1, further comprising a projection formed on a front face of the body portion as a deflection ridge that prevents use of the front face of the body portion as a golf ball hitting surface.

13. The adjustable golf club head according to claim 12, wherein the projection is formed as an integral part of the body portion.

14. A method of striking a golf ball, comprising the steps of:

(A) providing a golf club comprising an adjustable golf club head and a shaft connected to the golf club head, wherein the adjustable golf club head comprises a body portion comprising adjustment ports for receiving adjustment screws and locking ports for receiving locking screws, adjustment screws adapted to be screwed through the adjustment ports formed in the body portion, locking screws adapted to be screwed through the locking ports formed in the body portion, and a moveable face that is separable from the body portion, comprising a ball striking surface formed on an outer surface of said face, an inner surface comprising holes or indentations for receiving ends of the adjustment screws, and holes or indentations for receiving and securing ends of face locking screws, wherein the adjustment screws are formed and adapted to be screwed independently inwardly and outwardly in a direction extending between the body portion and the face so as to increase or decrease the length of the screw portions extending between the body portion and the face, thereby adjusting the distance between a plurality of respective points on the body portion and the face, and wherein the locking screws are formed and adapted to secure the relative positions of the body portion and the face by engaging in the holes or indentations for receiving the locking screws;

(B) adjusting the relative positions of the face and the body portion by adjusting inwardly and outwardly the adjustment screws in a direction extending between the body portion and the face so as to increase or decrease the length of the screw portions extending between the body portion and the face, thereby adjusting the distance between a plurality of respective points on the body portion and the face;

(C) securing the relative adjusted positions of the body portion and the face by securing the locking screws into the holes or indentations for receiving the locking screws; and (D) striking the golf ball with said club.

* * * * *